United States Patent [19]

Cook et al.

[11] Patent Number: 4,460,165

[45] Date of Patent: Jul. 17, 1984

[54] REMOVABLE HATCH FOR BLAST FURNACE IRON THROUGH HOOD

[75] Inventors: Anthony Cook, Homewood; Robert P. Winters, Olympia Fields, both of Ill.

[73] Assignee: Interlake, Inc., Oak Brook, Ill.

[21] Appl. No.: 506,111

[22] Filed: Jun. 20, 1983

[51] Int. Cl.[3] ..... C21B 7/12

[52] U.S. Cl. ..... 266/158; 266/196; 266/231

[58] Field of Search ..... 266/158, 231, 196, 197, 266/195, 159, 45; 75/41, 42, 53, 46; 254/266; 222/590, 591; 164/337

[56] References Cited

U.S. PATENT DOCUMENTS

| | | | |
|---|---|---|---|
| 4,262,885 | 4/1981 | LaBate | 266/196 |
| 4,300,753 | 11/1981 | LaBate | 266/196 |
| 4,354,668 | 10/1982 | Ernst | 266/158 |
| 4,357,003 | 11/1982 | Vajda | 266/158 |

FOREIGN PATENT DOCUMENTS

| | | | |
|---|---|---|---|
| 4006727 | 2/1974 | Japan | 266/196 |
| 0583162 | 12/1977 | U.S.S.R. | 266/197 |
| 0711102 | 2/1980 | U.S.S.R. | 266/196 |

*Primary Examiner*—L. Dewayne Rutledge
*Assistant Examiner*—S. Kastler
*Attorney, Agent, or Firm*—Emrich & Dithmar

[57] ABSTRACT

Apparatus for controlling emissions from the cast house of a blast furnace system includes hood means covering the iron trough from the blast furnace, the hood means having a hatchway formed therein adjacent to the blast furnace discharge notch and closed by a vertically-removable hatch cover which is raised and lowered by cables which extend upwardly over sheaves carried by a yoke assembly mounted on the bustle pipe immediately above the iron trough and then to a remote winch. Means are provided on the yoke assembly for latching the latch cover in its raised position.

19 Claims, 10 Drawing Figures

7
6
15
51
50
49
53
56
46
59
54
45
8
47
44
57
43
78
35
39
40
76
58
37
34
36
41
38

51
45
52
15
50
47
48
49
44
57
76
75
73
35
43
36
40
39
41
38

49
45
58
50
46
47
53
48
59
54
55

73
72
71
70
68
69
64
74

44
73
43
39
35
42
36
40
41

REMOVABLE HATCH FOR BLAST FURNACE IRON THROUGH HOOD

BACKGROUND OF THE INVENTION

The present invention relates to systems for controlling the emissions from a blast furnace cast house and, in particular, to means for suppressing the emission of fumes from the iron troughs and runners of the blast furnace cast house.

One method of controlling cast house emissions is to provide hood or cover means for the iron troughs and runners extending between the blast furnace discharge notch and the associated iron ladles and slag collectors. These hood means are arranged so as effectively to restrict ventilation of the iron troughs and runners and to direct the movement of objectionable fumes to collection apparatus. Typically this hood means includes a unitary elongated hood which covers the entire iron trough from the discharge notch of the blast furnace to the slag skimmer plate.

In order to gain access to the iron trough, for example to tap the furnace at the beginning of a cast, to determine how close the blast furnace is to the end of a cast, and to reseal the discharge notch at the end of a cast, it is necessary to remove this entire hood, which is extremely large and heavy. For this purpose, rail means have been provided which run over the iron trough and beneath the bustle pipe for supporting a trolley mechanism which carries suitable drive motors and hoisting apparatus. In use, the trolley mechanism is moved into place over the hood, the hoisting means are connected to the hood and the drive motors are operated to lift the hood off the iron trough. The trolley mechanism must then be moved along the rail away from the blast furnace for carrying the hood clear of the iron trough to permit workers, the tapping jack or the mud gun to be moved into place.

The removal of the hood exposes the entire length of the iron trough, thereby permitting significant amounts of harmful fumes to escape, significantly impairing the efficiency of the emission control system. Because of the size and weight of the hood, and because it must be moved away from the blast furnace, the transport mechanism therefor must be quite substantial. This entails considerable expense, and the trolley system includes permanently-mounted rails which obstruct the area over the iron trough and inhibit the access of workers and equipment thereto. It may even be necessary to modify the mounting of the tapping jack and/or the mud gun to permit them to be moved into position beneath the trolley rail means.

SUMMARY OF THE INVENTION

It is a general object of this invention to provide improved emission control apparatus for a blast furnace system, which avoids the disadvantages of prior apparatus while affording additional structural and operating advantages.

An important object of the invention is the provision of emission control apparatus for a blast furnace system which affords access to the iron trough, without significantly impairing the suppression of harmful emissions during such access.

In connection with the foregoing object, it is another object of this invention to provide emission control apparatus of the type set forth, which provides substantially unobstructed access to the iron trough by workers and associated equipment.

It is still another object of this invention to provide emission control apparatus of the type set forth, which includes simple and economical means for quickly and easily providing access to the iron trough and the discharge notch.

These and other objects of the invention are attained by providing in emission control apparatus for a blast furnace system including a blast furnace and an iron trough adapted to carry a molten stream from the blast furnace, the improvement comprising: a hood covering the iron trough along the length thereof and effectively preventing ventilation thereof, a hatchway in the hood adjacent to the furnace, and a removable hatch cover on the hood for opening and closing the hatchway.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
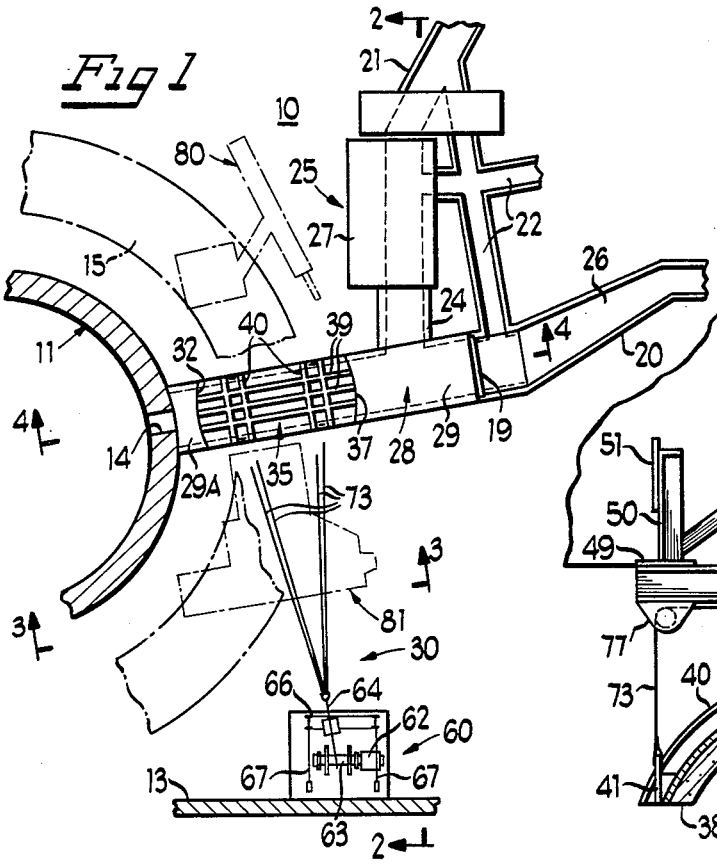
FIG. 1 is a fragmentary top plan view of the emission control apparatus of the present invention, with the associated parts of the blast furnace illustrated in horizontal section.

Referring now to FIGS. 1 through 4 of the drawings, there is illustrated a blast furnace system, generally designated by the numeral 10, which includes a conventional blast furnace 11 disposed over a hearth on a sloping floor 12 of a cast house having side walls 13. Formed in the wall of the blast furnace 10 at the lower end thereof is a discharge notch 14 for tapping the blast furnace 11. A conventional bustle pipe 15 encircles the blast furnace 11 a predetermined distance above the cast house floor 12. Formed in the cast house floor 12 is an iron trough 17 which is substantially rectangular in transverse cross section and extends from the discharge notch 14 radially outwardly from the blast furnace 11. Formed along the opposite side edges of the iron trough 17 are lips 18 which project upwardly above the level of the cast house floor 12. The iron trough 17 terminates at a skimmer plate 19 which spans the iron trough 17 and projects downwardly thereinto a predetermined distance for skimming the slag in a well known manner. The outer end of the iron trough 17 communicates with an iron runner 20 beyond the skimmer plate 19. Just ahead of the skimmer plate 19, the iron trough 17 communicates with a slag runner 21. Drain runners 22 extend from the tail end of the iron trough 17 adjacent to the skimmer plate 19, all in a well known manner.

The blast furnace system 10 has an emission control system, generally designated by the numeral 25, which includes covers for the trough and runners. More specifically, there is provided a hood 26 for the iron runner 20 and hoods 24 and 27 for the slag runner 21. A hood 28 is also provided for the iron trough 17, including a main section 29 and a short section 29A. Each of the hoods 26–28 is substantially part-cylindrical in transverse cross section and spans the associated trough or runner and may be secured in place by suitable means (not shown).

Figure 3:
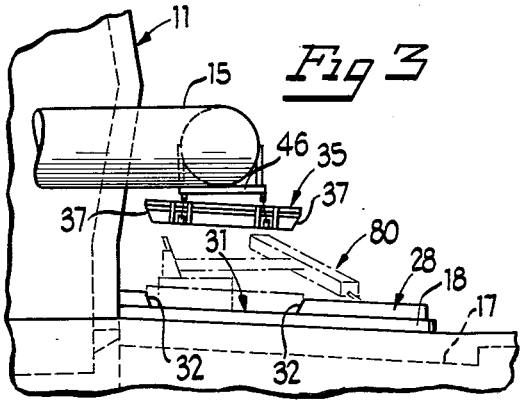
FIG. 3 is a fragmentary view in vertical section taken generally along the line 3—3 in FIG. 1, and illustrating the hatch cover of the present invention in its raised or open position.
Figure 4:
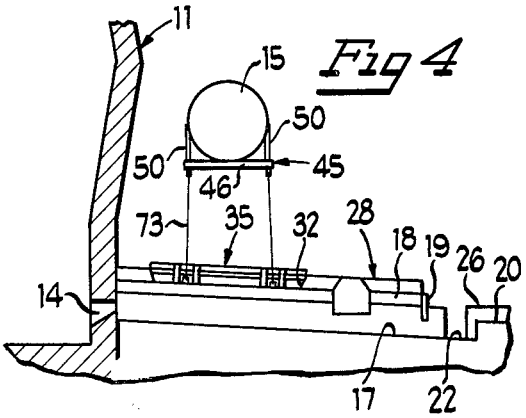
FIG. 4 is a fragmentary view in vertical section taken along the line 4—4 in FIG. 1, and illustrating the hatch cover of the present invention in its closed position.

In order to permit access to the iron trough 17 and to the discharge notch 14, the present invention includes an access system, generally designated by the numeral 30. The access system 30 includes a hatchway 31 formed in the iron trough hood 28, the hatchway 31 extending laterally completely across the iron trough 17 and extending longitudinally from the main section 29 to the short section 29A of the hood 28. The opposite ends of the hatchway 31 have slightly concave arcuate end surfaces 32, which are bevelled downwardly and longitudinally inwardly of the hatchway 31, as is best illustrated in FIG. 3, one of the ends 32 being disposed closely adjacent to the blast furnace 11 to facilitate access to the discharge notch 14, as will be explained more fully below.

The hatchway 31 is closed by a removable hatch cover 35, which is substantially in the form of a removable section of the hood 28. Referring in particular to FIGS. 5–7 and 10, the hatch cover 35 has a part-cylindrical main wall 36 which has convex end walls 37 bevelled downwardly and longitudinally inwardly (see FIG. 3) for mating engagement with the bevelled ends 32 of the hatchway 31. The main wall 36 has a layer of refractory material 34 secured to the inner surface thereof. The lateral edges of the main wall 36 and refractory material 34 define substantially coplanar support surfaces 38 which are respectively disposed for engagement with the upper surfaces of the iron trough lips 18. The outer surface of the main wall 36 has fixedly secured thereto by a plurality of longitudinally extending, substantially parallel rails 39, interconnected by circumferentially extending webs 40 to provide reinforcement for the hatch cover 35. Fixedly secured to the outer surface of the main wall 36 and spanning adjacent ones of the webs 40, respectively adjacent to the four corners of the main wall 36, are four upstanding eyelet plates 41. Respectively pivotally mounted on the upper edges of the eyelet plates 41 are shackles 42 for a purpose to be explained more fully below. Respectively fixedly secured to the webs 40 substantially adjacent to the lateral midline of the hatch cover 35 are two pairs of upstanding lifting lugs 43, each pair of lifting lugs 43 supporting a transversely extending lifting pin 44 therebetween a predetermined distance above the outer surface of the main wall 36.

Fixedly secured to the bustle pipe 15 immediately above the hatchway 31 is a yoke assembly, generally designated by the numeral 45, which includes a rectangular bottom frame comprising parallel side rails 46 interconnected at the ends thereof by parallel end rails 47. Interconnecting the end rails 47 centrally thereof are two center rails 48 substantially parallel to each other and to the side rails 46. This rectangular frame is disposed against the underside of the bustle pipe 15 parallel to the axis thereof. Fixedly secured to the end rails 47, respectively adjacent to the ends thereof are four corner gussets 49. Four upright posts 50 are disposed with the lower ends thereof respectively fixedly secured to the corner gussets 49 and with the upper ends fixedly secured to the bustle pipe 15 by attachment plates 51. The posts 50 are interconnected along the front and back sides of the bustle pipe 15 with suitable sway braces 52, the upper ends of which are fixedly secured, as by welding, to the bustle pipe 15.

Figure 5:
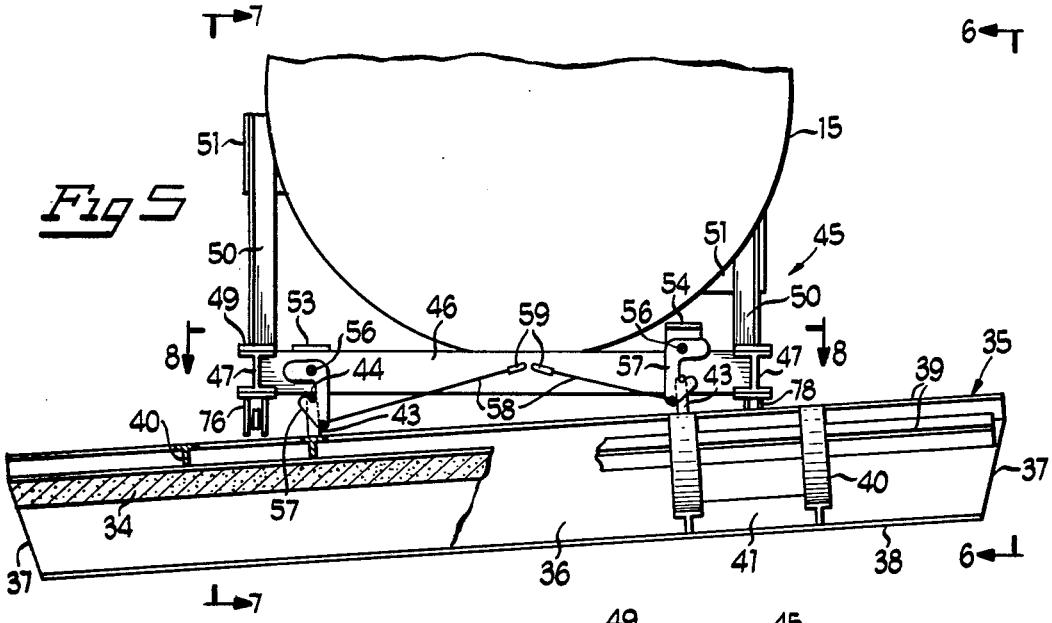
FIG. 5 is an enlarged, fragmentary side elevational view of the hatch cover of the present invention latched in its raised position of FIG. 3, but viewed from the opposite side thereof, with portions broken away more clearly to show the construction.
Figure 8:
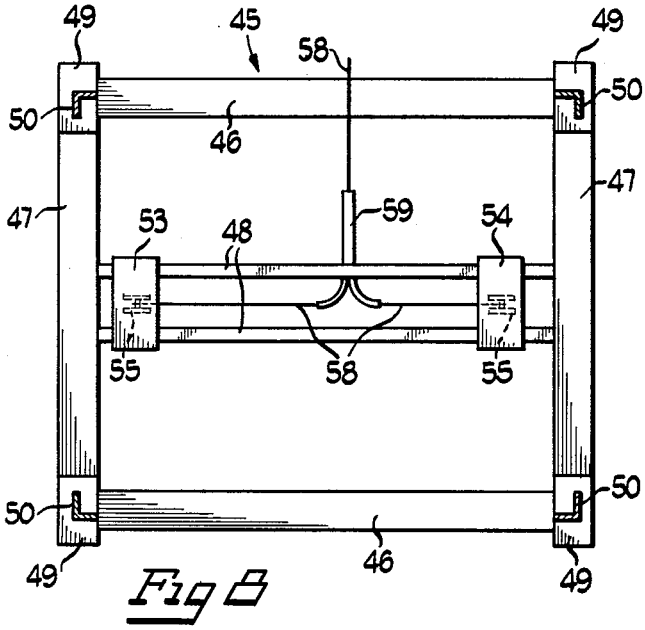
FIG. 8 is a view in horizontal section taken along the line 8—8 in FIG. 5, and illustrating a portion of the yoke assembly of the present invention.

Two rectangular support plates 53 and 54 span the center rails 48, respectively adjacent to the opposite ends thereof, the support plate 53 being disposed on the upper edges of the center rails 48 and the support plate 54 being supported by suitable means a predetermined distance above the upper edges of the center rails 48, as is best seen in FIG. 5. Each of the support plates 53 and 54 supports a depending clevis bracket 55 (see FIG. 8), each of the clevis brackets 55 carrying a pin 56 on which is pivotally mounted a hook 57. The lower ends of the hooks 57 are respectively fixedly secured to cables 58 which are trained over a guide 59 in one of the center rails 48 and thence to a manually-operated cable actuating mechanism (not shown) for pivoting the hooks 57. Preferably, the hooks 57 are resiliently biased by suitable means (not shown) to a normal rest position, illustrated in FIG. 5, and are moved against the urging of that bias means by use of the cables 58 to an unlatching condition.

Figure 6:
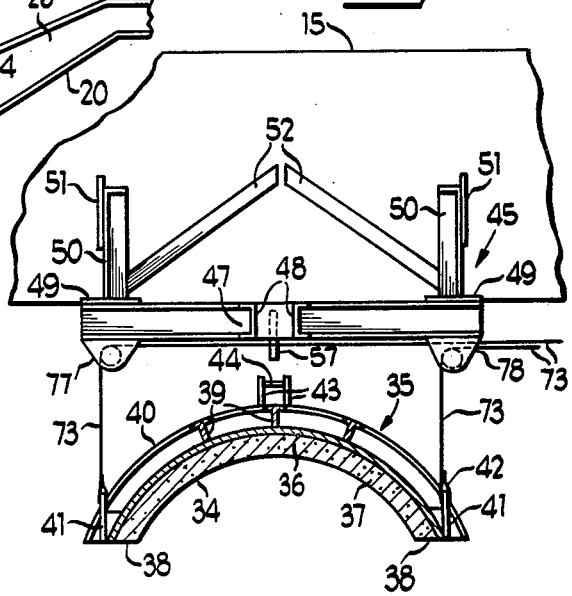
FIG. 6 is an end elevational view of hatch cover of the present invention, taken generally along the line 6—6 in FIG. 5, and illustrating the hatch cover slightly lowered from its fully raised position.
Figure 7:
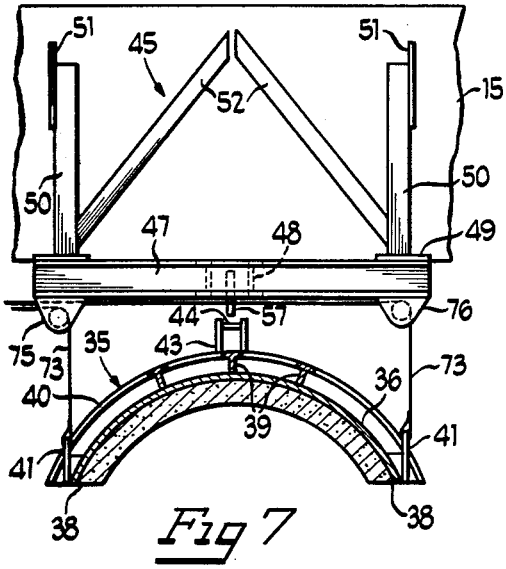
FIG. 7 is a view in vertical section taken along the line 7—7 in FIG. 5, but illustrating the hatch cover in the position of FIG. 6.
Figure 9:
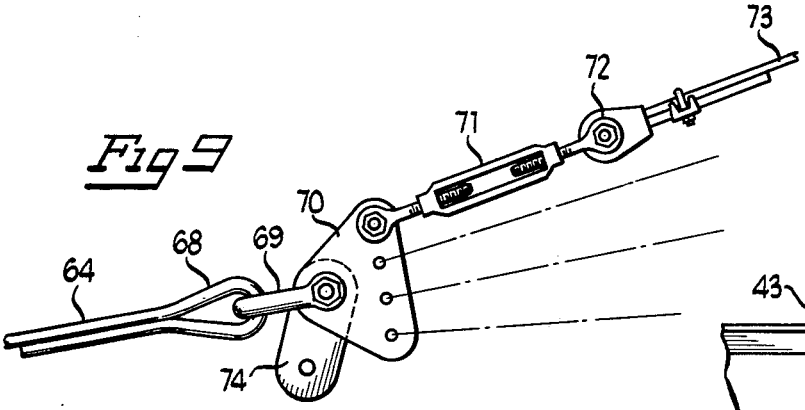
FIG. 9 is an enlarged, fragmentary, top plan view of the cables of the winch assembly of the present invention.
Figure 10:
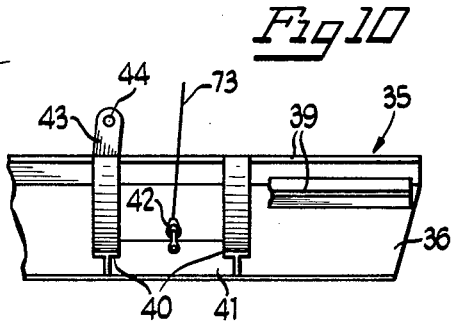
FIG. 10 is a fragmentary side elevational view of a portion of the hatch cover of FIG. 5, illustrating the manner of connection of the hoisting cable thereto.

The access system 30 also includes a winch assembly, generally designated by the numeral 60 (see FIGS. 1 and 2), which is mounted on a concrete foundation 61 in the cast house floor 12. The winch assembly 60 includes a motor 62, which may be a suitable electric motor, the output shaft of which is coupled to a spool or drum 63, to which is secured a main cable 64. The main cable 64 extends upwardly around a sheave 65 mounted in the upper end of a post assembly 66, which may be stayed, as by guy wires 67. The free end of the main cable 64 is coupled, as by a thimble 68 and shackle 69 to a connecting plate 70 (see FIG. 9), which is in turn coupled to four turnbuckles 71 (one shown). Each of the turnbuckles 71 is coupled by a corresponding shackle 72 to one of four branch cables 73, which respectively extend around sheaves 75, 76, 77 and 78 on the yoke assembly 45, and thence downwardly to the hatch cover 35, being respectively secured to the shackles 42 on the eyelet plates 41. The sheaves 75–78 are respectively secured to the yoke assembly 45, respectively at the corners of the rectangular frame, depending therefrom as is best illustrated in FIGS. 5–7.

The winch assembly 60 is disposed well away from the iron trough 17, and the height of the post assembly 66 is such that the sheave 65 is mounted well above the cast house floor 12, preferably at least about six feet, but below the level of the bottom of the bustle pipe 15. Thus, the path of the cables 73 from the winch assembly 60 to the yoke assembly 45 is closely adjacent to the level of the bottom of the bustle pipe 15 so as to maintain the area beneath the bustle pipe substantially unobstructed. The width of the yoke assembly 45 is preferably substantially the same as the width of the iron trough 17, so that the path of the cables 73 from the yoke assembly 45 to the hatch cover 35 is directly above the hatch cover 35 and does not obstruct the areas outboard of the iron trough 17 beneath the bustle pipe 15.

Figure 2:
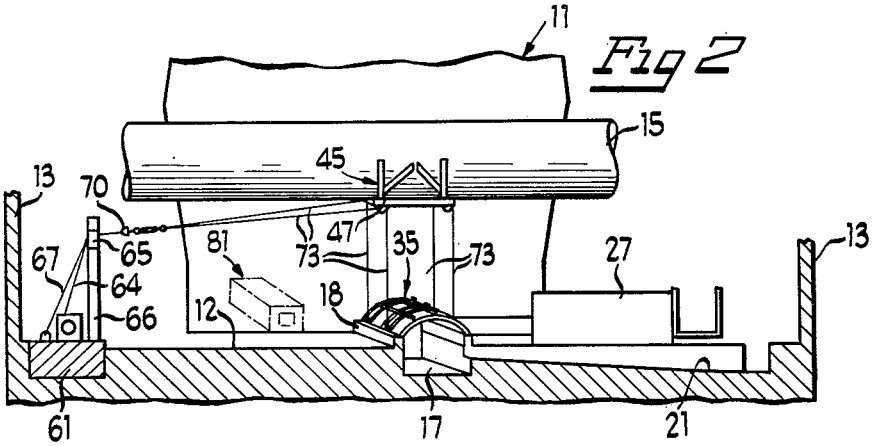
FIG. 2 is a fragmentary view in vertical section taken along the line 2—2 in FIG. 1, and illustrating the hatch cover of the present invention in its lowered or closed position.

In operation, when it is desired to open the hatchway 31, the winch assembly 60 is operated for withdrawing the branch cables 73 to the left, as viewed in FIG. 2, thereby lifting the hatch cover 35 vertically from the iron trough 17 for opening the hatchway 31. The hatch cover 35 can be raised to a fully retracted position, illustrated in FIGS. 3 and 5, against the bottom frame of the yoke assembly 45. As the hatch cover 35 moves to its fully retracted position, the lifting pins 44 engage the hooks 57 and cam them back away from their latching conditions, the hooks 57 then snapping back beneath the pins 44 for engagement therewith, as illustrated in FIG. 5, positively to support the hatch cover 35 in its retracted position. The hooks 57 thus afford added safety by providing an added support for the hatch cover 35 in its retracted position. For releasing the hatch cover 35 from its fully retracted position, the winch assembly 60 is engaged to raise the hatch cover 35 slightly and remove the load from the hooks 57, whereupon the hooks 57 are released by pulling on the cables 58. The hatch cover 35 may then be lowered by reversing the operation of the winch assembly 60, and the hooks 57 can be returned to their normal latching position under the urging of their associated bias means.

In its retracted position, the hatch cover 35 is disposed well above the iron trough 17 by a distance sufficient to permit clear and unobstructed access to the hatchway 31 by workers and to permit an associated tapping jack 80 and a mud gun 81 to be swung freely into position without obstruction. In this regard, it will be noted that the length of the hood section 33 is short enough to permit access to the discharge notch 14 by the tapping jack 80 and the mud gun 81 through the open hatchway 31. Thus, it will be appreciated that at the beginning of a cast, the hatch cover 35 will be raised and the tapping jack 80 swung into place to tap the discharge notch 14 to begin the cast. The hatch cover 35 is then lowered back into position by reversing the operation of the winch assembly 60. In this regard, it will be appreciated that the bevelled ends 37 of the hatch cover 35 mate with the ends 32 of the hatchway 31 to facilitate accurate seating of the hatch cover 35 in the hatchway 31. If desired, the hatch cover 35 may be secured in place by suitable means. It will be appreciated that during a cast, the hatch cover 35 can be quickly and easily raised by the winch assembly 60 so that a worker can look into the iron trough 17 to determine how close the blast furnace 11 is to the end of the tap. The hatch cover 35 can then be very quickly lowered back into place for reclosing the hatchway 31, minimizing the amount of emissions discharged during the inspection. At the end of the tap the hatch cover 35 is again raised and latched in its fully retracted position to permit the mud gun 81 to be swung into place for resealing the discharge notch 14.

From the foregoing, it can be seen that there has been provided an improved blast furnace emission control system of the type which provide hoods for the troughs and runners, wherein quick and easy access to the iron trough and to the discharge notch of the furnace can be readily effected with simple and economical apparatus and with a minimum discharge of harmful fumes, and in a manner which maintains the area around and over the iron troughs substantially unobstructed.

We claim:

1. In emission control apparatus for a blast furnace system including a blast furnace having a discharge notch and an iron trough adapted to carry a molten stream of slag and metal from the discharge notch to a skimmer plate for separating the slag from the metal, the improvement comprising: an elongated hood covering the iron trough and extending the entire length thereof from the discharge notch to the skimmer plate, a hatchway in said hood adjacent to the discharge notch and extending along only a portion of the length of said hood, a removable hatch cover on said hood separable therefrom for opening and closing said hatchway, drive means remote from the iron trough, means coupling said drive means to said hatch cover for effecting movement thereof between a normal lowered position closing said hatchway and a raised position spaced from said hood and opening said hatchway, and guide surfaces on said hood and on said hatch cover for cooperation to guide said hatch cover to its lowered position, said hatch cover in the lowered position thereof cooperating with said hood for effectively preventing ventilation of the iron trough, said hatch cover in the raised position thereof being spaced well above the trough so as to afford substantially unobstructed access to the uncovered portion of the iron trough and to the discharge notch.

2. The emission control apparatus of claim 1, wherein said hatchway defines a gap in said hood extending laterally entirely thereacross.

3. The emission control apparatus of claim 1, wherein the length of said hatch cover is substantially less than the overall length of said hood.

4. The emission control apparatus of claim 1, wherein said hatch cover is only vertically removable from said hood.

5. The emission control apparatus of claim 4, wherein the opposite ends of said hatch cover and the portions of said hood defining said hatchway are all beveled downwardly and longitudinally inwardly of said hatchway to form said guide surfaces for facilitating accurate seating of said hatch cover in said hatchway.

6. The emission control apparatus of claim 5, wherein the opposite ends of said hatch cover respectively lie in planes which intersect beneath said cover.

7. The emission control apparatus of claim 1, wherein said coupling means is arranged for effecting substantially vertical movement of said hatch cover between the raised and lowered positions thereof.

8. The emission control apparatus of claim 1, wherein said drive means comprises an electric drive motor.

9. The emission control apparatus of claim 8, wherein said coupling means comprises elongated flexible connecting means.

10. The emission control apparatus of claim 9, wherein said coupling means comprises cable means.

11. The emission control apparatus of claim 1, and further including latch means for holding said hatch cover in the raised position thereof.

12. The emission control apparatus of claim 11, and further including manually operable means for releasing said latch means.

13. In emission control apparatus for a blast furnace system including a blast furnace having a discharge notch, an iron trough adapted to carry a molten stream from the discharge notch to a skimmer plate and a bustle pipe encircling the blast furnace a predetermined distance above the iron trough, the improvement comprising: an elongated hood covering the iron trough along the entire length thereof from the discharge notch to the skimmer plate, a hatchway in said hood adjacent to the discharge notch and extending along only a portion of the length of said hood, a removable hatch cover on said hood separable therefrom for opening and closing said hatchway, a winch remote from the iron trough, sheave means carried by the bustle pipe directly above the iron trough, cable means coupled to said winch and extending over said sheave means and connectable to said hatch cover for effecting movement thereof between a normal lowered position closing said hatchway and a raised position spaced from said hood and opening said hatchway, and guide surfaces on said hood and on said hatch cover for cooperation to guide said hatch cover to its lowered position, said hatch cover in the lowered position thereof cooperating with said hood for effectively preventing ventilation of the iron trough, said hatch cover in the raised position thereof being disposed closely adjacent to the bustle pipe so as to afford substantially unobstructed access to the uncovered portion of the iron trough and to the discharge notch.

14. The emission control apparatus of claim 13, and further including support means mounted on the bustle pipe for supporting said sheave means.

15. The emission control apparatus of claim 13, wherein said cable means includes plural cables respectively connectable to said hatch cover at spaced-apart points thereon.

16. The emission control apparatus of claim 15, wherein said hatch cover is generally rectangular in plan outline, said cable means including four cables respectively connectable to said hatch cover adjacent to the four corners thereof.

17. The emission control apparatus of claim 13, wherein said sheave means is disposed closely adjacent to the bustle pipe, and further including cable guide means disposed adjacent to said winch for guiding said cable means upwardly from said winch to substantially the height of said sheave means and then laterally to said sheave means.

18. The emission control apparatus of claim 13, and further including latch means supported by the bustle pipe and engageable with said hatch cover for latching said hatch cover in the raised position thereof.

19. The emission control apparatus of claim 18, and further including bias means resiliently urging said latch means to a normal latching condition, and manually-operated means for releasing said latch means from the latching condition thereof.

* * * * *

UNITED STATES PATENT AND TRADEMARK OFFICE

CERTIFICATE OF CORRECTION

PATENT NO. : 4,460,165

DATED : July 17, 1984

INVENTOR(S) : Anthony Cook and Robert P. Winters

It is certified that error appears in the above-identified patent and that said Letters Patent are hereby corrected as shown below:

[54] In the Title "THROUGH" should be --TROUGH--.

Signed and Sealed this

*Eleventh* Day of *December 1984*

[SEAL]

*Attest:*

GERALD J. MOSSINGHOFF

*Attesting Officer* *Commissioner of Patents and Trademarks*